US005213667A

United States Patent [19]

Hozer

[11] Patent Number: 5,213,667

[45] Date of Patent: May 25, 1993

[54] ELECTROLYTIC BATH SOLUTION AND METHOD FOR IMPROVING THE SURFACE WEAR RESISTANCE OF TOOLS

[76] Inventor: Norman R. Hozer, 14303 Glensford Pl., Louisville, Ky. 40245

[21] Appl. No.: 740,330

[22] Filed: Aug. 5, 1991

[51] Int. Cl.[5] ..... C25F 3/00

[52] U.S. Cl. ..... 204/129.55; 204/129.9

[58] Field of Search ..... 204/129.55, 129.9, 129.95

[56] References Cited

U.S. PATENT DOCUMENTS 4,710,279 12/1987 Hozer ..... 204/129.55

*Primary Examiner*—T. M. Tufariello

*Attorney, Agent, or Firm*—Vance A. Smith

[57] ABSTRACT

In accordance with one embodiment, a method for increasing the useful working life of a tool comprises providing a bath capable of removing a surface region of an unused tool containing material near the surface under mechanical stress, immersing the tool in the bath and applying an electric potential for a time period sufficient to remove the region.

17 Claims, 2 Drawing Sheets

ELECTROLYTIC BATH SOLUTION AND METHOD FOR IMPROVING THE SURFACE WEAR RESISTANCE OF TOOLS

BACKGROUND OF THE INVENTION

This invention relates generally to improvements in the wear quality of the surface of tools and more specifically relates to aqueous solutions and methods for improving the wear resistance of tools exposed to wear incurred in the normal operation of the machinery incorporating the tools.

U.S. Pat. No. 4,710,279 which issued on Dec. 1, 1987 to Norman R. Hozer (hereinafter known as the '279 Patent) disclosed a novel electro-chemical process and an unique electrolytic bath solution for restoring the sharpness of cutting tools. The process disclosed in the '279 Patent is based upon the principal of electro-chemical milling of a tool surface. That is, the tool is immersed into the electrolytic bath solution acting as a conducting electrolyte in which a portion of the surface of the tool is removed. Such electro-chemical milling processes have long been employed to impart smooth surfaces to irregular surfaces such as in deburring. Previous to the issuance of the '279 Patent, resharpening of cutting tools required the machinery incorporating the tools to be shut down while the tools were being reground to approximate the original sharpening edge. Alternatively, replacement tools were used during the refinishing stage, assuming the manufacturer was fortunate enough to have replacement tools on hand at the concomitant extra cost.

The '279 Patent provides for a novel electrolytic bath solution that can be employed to bathe the tools under certain electrolytic conditions that result in resharpened tools which are often superior in wear resistance to the original sharpened tool. Moreover, the time required for the resharpening has been reduced dramatically and, therefore, the downtime and/or the need for additional tools on hand greatly minimized. Finally. the direct costs heretofore attributable to the resharpening process itself has been reduced to a considerable extent through the use of the disclosed method for employing the aqueous solution.

While the electrolytic bath solution and the method disclosed in the Patent '279 have proven to provide a significant advance in the restoration of the sharpness of certain cutting tools and increased life, tools comprised of specific alloys such as, for example, carbide steel base alloys, resist the rapid refinishing of the tools apparently due to polarization occurring on the alloys. Such polarization requires a multiplicity of cycles of moving parts between the electrolytic bath solution and rinse. The need for several depolarization cycles increases the complexity of computer or other programs required for use on automated equipment. This in turn reduced production rates while increasing production costs. Thus, it is desirable that an improvement be made to the aforementioned electrolytic bath solution and method which permits the effective refinishing of such alloys which heretofore have resisted any refinishing.

It has been additionally noted that at certain operating temperatures, the electrolytic bath solution described in Patent '279 may tend to crystallize over time and certain supportive compounds in the solution precipitate out of solution. The occurrence of undesired precipitation is exacerbated when the electrolytic solution is transported during colder periods of the year or where the ambient temperature of the surrounding environment is low. The effect of such crystallization is that the solution may not be at continued optimal effectiveness during operation of the process on tools immersed in the bath, e.g., resharpening the cutting edge of an immersed tool. Therefore, an improvement in the stabilization of the electrolytic bath solution over a wider temperature range would be desirable.

SUMMARY OF THE INVENTION

The present invention provides for an improved process for the refinishing of the edge of cutting tools. According to this aspect of the present invention, an electrolytic bath solution at essentially room temperature is provided as an electrolyte in which a cutting tool to be refinished is immersed. An electrical potential is applied between the tool and bath solution at a predetermined level for a predetermined period of time. Certain minute and undesired portions of the surface material of the tool are removed and the cutting edge of the tool is restored to equal or exceeds the initial quality and cutting function.

According to another aspect of the present invention cutting tools having a carbide constituency within the cutting surface region thereof are immersed in an electrolytic bath solution under an electrical potential at predetermined level for a predetermined time period. Certain other compounds are removed from the region with the resulting surface region being provided with fine projections of complex carbide material which enhance the cutting ability of the tool.

According to still another aspect of the present invention, tools which have "wearing surfaces" i.e., surfaces to be exposed to frictional and other operating conditions which cause the surfaces thereof to wear and deteriorate, are pretreated by immersion in an aqueous bath under an electrical potential at a predetermined level for a predetermined period of time. Certain portions of the wearing surfaces weakened due to the tool manufacturing process are removed thereby significantly extending the effective working life of the wearing surfaces.

An electrolytic bath solution according to the present invention used for immersing and (a) restoring the functional ability of the worn surface regions of the aforementioned cutting tools or (b) pretreating wearing surface regions of certain tools may comprise an aqueous solution of phosphoric acid, sulfuric acid.

BRIEF DESCRIPTION OF THE DRAWING

The invention will be described with reference to the accompanying drawing, wherein like numerals denote like elements, and.

DETAILED DESCRIPTION OF PREFERRED EXEMPLARY EMBODIMENTS

Figure 1:
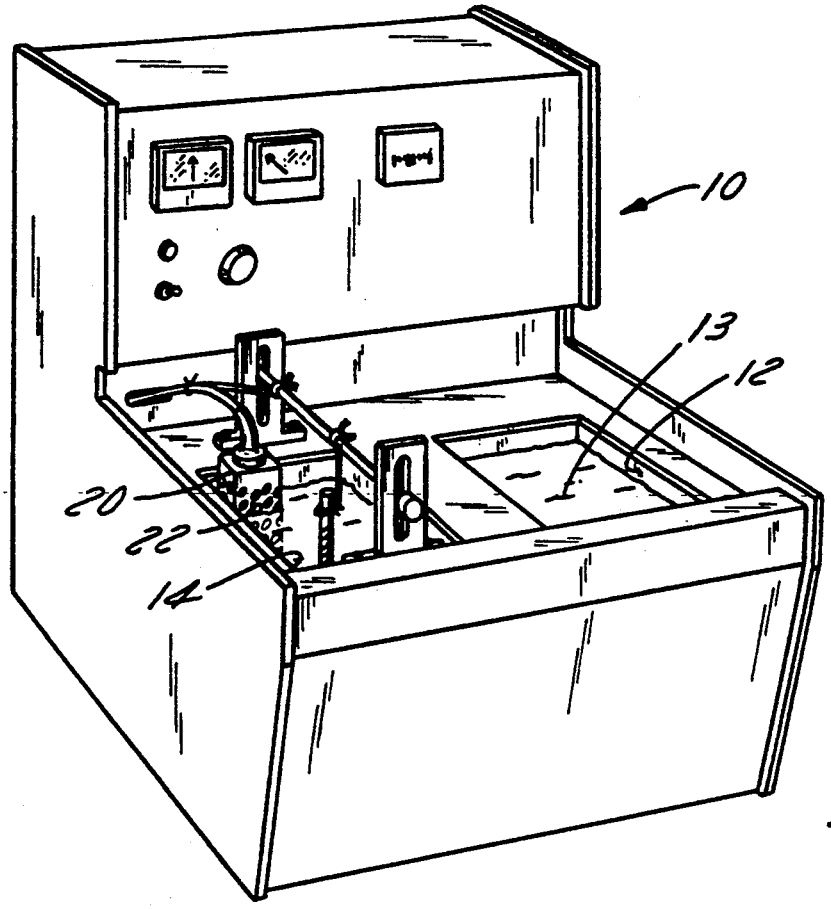
FIG. 1 is a schematic of an apparatus that may be used with an aqueous solution or practice a process in accordance with the present invention.

Tools which have work surfaces repeatedly coming into contact with work pieces must ultimately be replaced or refinished due to the wear on the work surface itself. Tools employing knife edges are particularly susceptible to the wear resulting from repeated cutting operations. Examination of worn work surfaces under magnification shows the appearance of cracks and crevices in the regions adjacent to the work surfaces. Continued use of such worn tools results in unsatisfactory work performance and ultimate destruction of the tool itself due to material failure of the region adjacent the work surface. During prolonged use, the cracks that are in the work surface continue to propagate, become connected, and pieces of the tool adjacent the work surface literally become removed from the tool.

The predicted wear life of a particular tool depends upon a number of factors among which are the nature of the material comprising the tool itself, the heat generated during the work operation from frictional contact with the work piece, the number of expected repetitious work operations of the tool, and the nature of the material comprising the work piece. Attempts to increase the expected work life of a particular tool have been multitudinous and varied. For example, various alloys known generically as high speed steels, carbide based alloys, and cobalt alloy steels have been used as the main component of the wearing surfaces some tools to increase wear life with some success. In other techniques such as in cutting operations, the tolerances are tightly controlled in an effort to reduce the heat created and the deleterious effect thereof upon the tool. The use of wear resistant coatings over the wear surfaces have found favor in some instances. Finally in recognition that the machining of the tool itself sets up stresses in the surfaces of tools, others have pretreated the tools through certain techniques designed to relieve the stress such as heat, vibrational, and electrical treatments.

Applicant in exploring the techniques traditionally used in the past to increase the work life of tools has noted that the stresses created in the work surface region of the tool by the process of making the tool is a significant contribution to the shortened wear life of many tools. An examination of the surfaces of such tools under high magnification shows that the surfaces have fine and unconnected stress cracks largely confined to the thin region underlying the surface. The cracks propagate and connect as the tool us used causing the associated wear in the tool surfaces leading initially, in the case of cutting tools, to dull cutting edges and ultimately to unusable tools. Applicant has noted that the surface region in which the aforementioned stress is induced is largely comprised of a thin layer of oxides, particularly when the tool is comprised of ferrous alloys such as plain carbon steel and martensitic and austenic steels. Such oxide layers form quickly on the ferrous alloy materials and are present when the material is ground or otherwise shaped into the predetermined tool form. By selectively removing the thin oxide layer containing the induced stress and leaving the other constituent components of the tool unaffected, applicant has successfully and substantially minimized the debilitating effects of the mechanical machining of the tools as manifested in uneven surface stress, mechanical stress crack propagation, and disturbed edge temper and embrittlement. The surface region left has increased toughness and tensile strength with superior elastic qualities. Tools in which such layers have been removed show a substantial increase in wear life with all of the concomitant cost savings one would expect with longer tool life.

Reference is now made to the schematic of FIG. 1 of an apparatus, depicted generally by the numeral 10, which may be used to practice the present invention, As illustrated, apparatus 10 has separate containers, each of which provides a different function in the treatment of a tool. Container 12 is filled with a liquid 13 such as a solvent to degrease the tool prior to the removal of the oxide layer so as to maximize the efficiency of such removal and to prevent contamination of the electrolytic bath solution. Solutions used for degreasing tools are often maintained at temperatures in the range of 160° to 100° F.

Once degreased the tool then can be removed to the second container 14 and the wearing surface area of the tool depicted herein by numeral 16 is immersed in an electrolytic bath solution 18. As illustrated, a heater housing electrode 20 comprising a metallic grid defining a plurality of holes 22 may be immersed in bath solution 18 to provide heat to the solution if needed. Holes 22 permit circulation of the electrolytic solution about a heater (not shown), which by way of example may be a quartz heater, positioned within housing 20. Sidewalls 24 may be formed from electric conductive material and act the cathode for the solution. Tool 16 functions as the anode while bath solution 18 comprises the electrolyte. The cathode and anode are connected to a source of electrical energy (not illustrated). By providing an electric potential difference of a predetermined value across the electrolyte for a predetermined period of time the bath solution of the present invention quickly removes the oxide layer overlying the working surface area of the tool 16. Next the tool 16 is removed from container 14 and cycled into still another container enclosing a rinse bath solution such as water to remove any residual aqueous solution on the surface of the tool 16.

The process and the aqueous composition are extremely suited for use in an automated environment in which the degreasing, treatment of the wearing surface, and rinsing are done automatically and rapidly. Any device for transporting the tools such as, for example, a carrousel device shown in the aforementioned U.S. Pat. No. 4,710,279, may be employed to cycle tools through the various steps needed to degrease, remove the overlying oxide layer, and rise the tool under treatment.

The composition made in accordance with the present invention when used properly can provide a tool surface with changed morphology, structure and composition providing a tool with enhanced cutting ability and longer life. In the following example, an unused high speed steel drill bit is dipped into an electrolytic solution in accordance with the present invention and then compared under microscopic examination with an identical unused drill bit which was not so treated.

A primary solution was prepared using about 71% phosphoric acid, about 7% sulfuric acid, about 27 grams of nickel carbonate per gallon of the primary solution, about 3.5 grams of ferric oxide per gallon, and about 0.375 grams of chromium sequesoxide per gallon. The remainder of the solution was water. The solution was determined to have a specific gravity of about 1.45 and was then set aside.

A second solution was then prepared and comprised of water and phosphoric acid in respective amounts of about 80–82% and 18–20% by volume. To this solution was added about 0.1 grams of sodium thiosulfate per gallon of the secondary solution and about 9.5 grams per gallon of the second solution of ultra violet basic salts. This mixture was stirred until completely dissolved and left standing for between about 30 minutes to an hour. The mixture was then added to the primary solution at about ½ to 1% of the basic solution.

Figure 2:
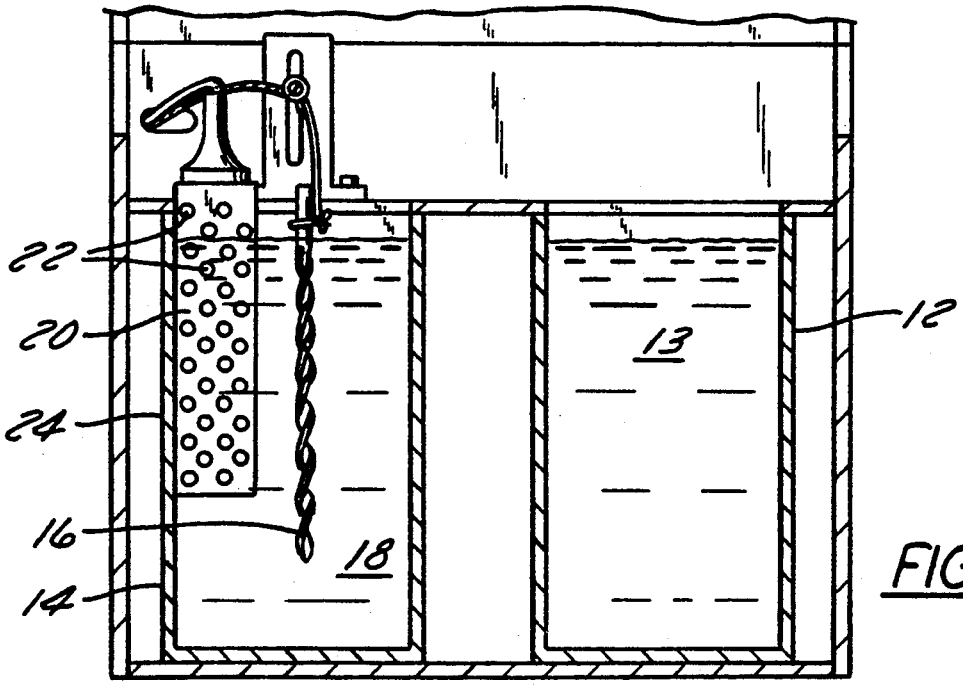
FIG. 2 is a schematic view of an apparatus that may be used with an aqueous solution or practice a process in accordance with the present invention.

The electrolytic solution was then placed into container such as that set forth as illustrated in FIGS. 1 and 2. A 11.00 mm unused drill bit was then immersed in the electrolytic bath and connected to a remote electrical source as an anode. The temperature of the bath was maintained at a range of temperatures near ambient conditions, e.g., between about 80°–90° F. A voltage of about 6 volts was applied with the current density being measured at between about 72 to 560 amps per square foot. The tool was maintained in an immersed condition for about 30 seconds.

Figure 3:
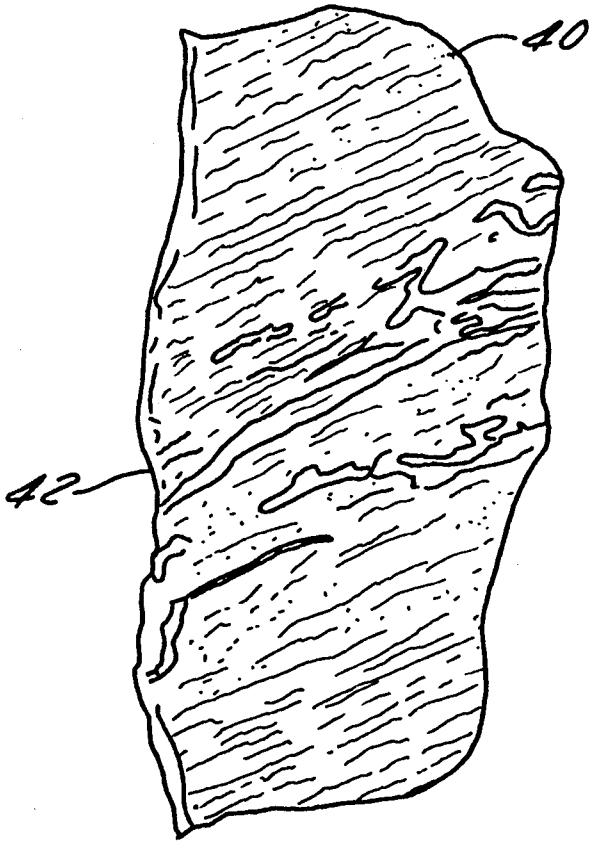
FIG. 3 is an artistic rendition of a photograph of a region of an unused cutting edge of carbide steel cutting tool under 10,000 X magnification before being immersed in an electrolytic bath solution in accordance with the present invention.

The treated drill bit was then compared to an untreated drill bit using a scanning electron microscope at 10,000 X magnification. Under the microscope, the untreated drill bit exhibited considerable grinding marks in its exposed surface region 40, leaving a scalloped edge 42 and numerous metallic burrs. The scalloped edge 42 is clearly visible in the artistic rendition of an actual photograph set forth in FIG. 3. The grinding process produced fine cracks in the upper surface region of the tool which, if untreated, tend to accelerate wear.

Figure 4:
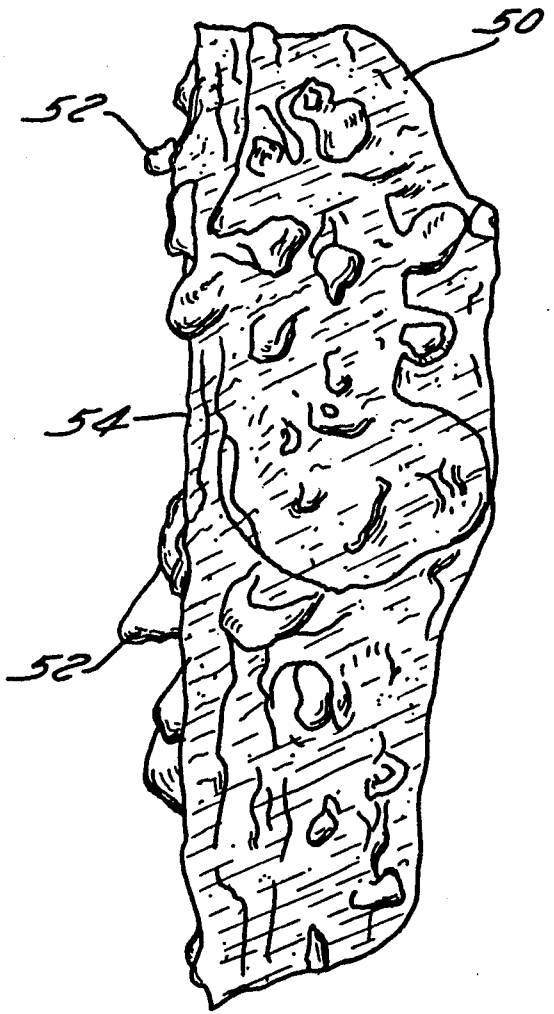
FIG. 4 is an artistic rendition of the region of the cutting edge of the tool of FIG. 3 under 10,000 X magnification after being immersed in an electrolytic bath solution in accordance with the present invention.

In contrast, the dipped drill displayed a completely different type of cutting surface. The process of treating the drill changed the morphology, structure and composition of the tool surface 50. As seen in FIG. 4, the tool displays a more linear cutting edge 54. The size and number of grinding marks was reduced dramatically as well as the elimination of the metallic burrs. Removal of the oxide layer tended to eliminate the fine cracks in the surface region and exposed the stress-free layer beneath the top surface. This surface provides increased resistance against wear of the tool.

Still another difference noted between the two drill bits were the appearance of protruding micron and submicron sized particles 15 imbedded in the surface of the treated drill. An x-ray diffraction analysis of the treated drill bit disclosed that the protruding particles were complex carbides of the structure type $Fe_3W_3C$—$Fe_4W_2C$ exposed due to the removal the oxide layer ($Fe_2O_4$ and $Fe_4O$) by the electrolytic bath. The larger density of such protruding abrasive particles provided a surface that results in more aggressive, longer lasting drill bit.

While the optimum amount of phosphoric acid is about 71%, it has been determined that values of about 50% to 80% may be employed depending upon the composition of the tool to be treated. Similarly, it has been found that the sulfuric acid volume percent may range from about 0% to 25% with about 8% being a preferred value for sulfuric acid. Additionally, it has been learned that the values of the other constituents of the primary solution may also be varied within range limits. Nickel carbonate may be effectively used in a range of about 26 to 53 grams per gallon of the primary solution although a value of about 26 grams per gallon is preferred. Ferric oxide may used in the range of about 1.7 to 5 grams per gallon with about 3.5 grams being the preferred value.

It has been noted that the addition of chromium sequesoxide in the amount of between about 0.2 and 1.3 grams per gallon, with about 0.4 grams per gallon, being preferred enhances the endurance of the electrolytic bath to remove the oxide layers. It has been further determined that the addition of the secondary solution and chromic sequesoxide enhances the removal of the oxide layers and substantially minimizes the recurrence of polarization which otherwise requires frequent washing. Chromic acid may be employed in place of the chromium sequesoxide for cost saving purposes although the latter is preferred. The ultraviolet basic salts may be added at the rate of 7 to grams per gallon of the second solution with about 9.5 grams per gallon being preferred.

Additionally, it has been observed that the proper specific gravity of the solution plays an important role in minimizing undesired polarization and the necessary frequent rinsing that results. Excess specific gravity results in polarization. However, values that are too low result in aggressive solutions that attack the tool material itself. Consequently, by selecting specific gravity at values between about 1.4 and 1.57, a solution can be obtained which functions satisfactorily.

A major advantage of using the electrolytic solution of the present invention over prior art electromilling processes employed with worn tools is that no round edges are produced on the tool edge. Thus, when refinishing worn tools are refinished in accordance with the present invention, the edges of the tool are restored to original sharpness. When such tools have complex carbide particles embedded in the region of the surface, the electrolytic surface advantageously removes the oxide layer and other alloy material, leaving the hard complex carbide particles exposed enhancing both life and cutting ability of the tool.

From the above it can be seen that the electrolytic bath solution made in accordance with the present invention not only can restore the cutting edges to worn cutting tools but it may be employed to provide longer life to tools in general by removing the oxide surface areas containing stressed regions caused by the manufacturing process. Tools which have the extremely hard complex carbide structures embedded in the oxide regions become exposed after being dipped in the electrolytic bath solution and provide enhanced burring ability to the tool surface. Thus, the electrolytic bath solution and process provide changes to the morphology, structure and composition of the tool working surface, resulting in superior strength, longer life, and cutting ability. Additionally, the need to employ numerous rinse cycles for certain tools during treatment due to polarization is largely eliminated through use of the bath solution. This results in the reduction in processing time with concomitant cost savings. Other advantages, modifications, and applications will become clear to those skilled in the art from a reading of the attached description and drawing without departing from the spirit of the invention.

I claim:

1. A method for enhancing the cutting edge of an unused steel cutting tool having complex carbide particles positioned beneath an oxide layer overlaying a region of the cutting surface of the unused cutting tool comprising the steps of:

(a) providing a bath of solution capable of selectively removing the oxide layer which overlaps the cutting surface region and envelopes the complex carbide particles when said tool is immersed in said bath solution, (b) immersing said unused tool within said bath solution, and (c) applying a predetermined electrical potential between said unused tool and an electrode located within said bath solution for a time sufficient to remove the oxide layer and expose the complex carbide particles thereby increasing the abrasiveness and enhancing the ability of the cutting edge of the unused tool to cut objects.

2. The method of claim 1 in which said electrolytic bath is comprised of phosphoric acid, nickel carbonate, ferric oxide, one of group consisting of chromic acid or chromic sequesoxide, sodium thiosulfate, and alta violet basic salts.

3. The method of claim 2 in which said bath has a specific gravity of between about 1.4 and 1.57.

4. The method of claim 2 in which the bath solution includes sulfuric acid.

5. The method of claim 2 in which the phosphoric acid comprises between about 53% to 78% of the electrolytic bath solution.

6. The method of claim 2 in which the temperature of the bath is about 80° to 145° F.

7. The method of claim 2 in which the electrical potential is from about 1 to 8 volts.

8. The method of claim 6 in which the tool is immersed for a time period of 15 seconds to 60 minutes.

9. A method for the pretreating the wearing surface of an unused tool comprising the steps of:

(a) providing a bath of aqueous solution capable of removing a surface region of an unused tool containing material near the surface thereof under mechanical stress when said tool is immersed in the bath under an electric potential between said tool and an electrode located within said bath, (b) immersing said tool with said bath, (c) locating said tool with said bath, and (d) applying an electric potential for a time period sufficient to remove said surface region thereby exposing previously underlying regions having less mechanical stress.

10. The method of claim 17 in which said bath has a specific gravity of between about 1.4 and 1.57.

11. The method of claim 17 in which the bath solution includes sulfuric acid.

12. The method of claim 17 in which the phosphoric acid comprises between about 53% to 78% of the electrolytic bath solution.

13. The method of claim 11 in which the temperature of the bath solution is about 80° F. to 145° F.

14. An electrolytic bath solution useful in the strengthening of a tool working surface comprising (a) a first solution portion having between about 53% to 78% by volume of phosphoric acid and added stabilizers of ferric oxide, nickel carbonate and one of a group selected from a group consisting of chromic acid and chromic sequesoxide and (b) a second solution portion added to said first solution portion in an amount between 0.5 to 1% of the volume of said first portion, said second portion comprising about 18 to 20% by volume of phosphoric acid, 80 to 82% by volume of water, about 0.1% sodium thiosulfate by weight, and a predetermined amount of alta violet basic salts.

15. The solution of claim 14 in which the first portion includes sulfuric acid in an amount not exceeding 25% by volume.

16. The solution of claim 14 in which the specific gravity thereof is between about 1.4 and 1.57.

17. A method for the treatment of a wearing surface of a tool comprising the steps of:

(a) providing a bath of aqueous solution capable of removing a surface region of said tool containing material under stress when said tool is immersed in the bath under an electric potential between said tool and an electrode located within said bath, said bath including an aqueous solution of a phosphoric acid, ferric oxide, one of group consisting of chromic acid or chromic sequesoxide, sodium thiosulfate, and a predetermined amount of alta violet basic salts, (b) immersing said tool within said bath, and (c) applying the electrical potential between said tool and said electrode for a time period sufficient to remove said surface region thereby exposing regions of said tool having less mechanical stress.

* * * * *